US005885941A

United States Patent [19]

Šateva et al.

[11] Patent Number: 5,885,941

[45] Date of Patent: Mar. 23, 1999

[54] THREAD COMPOUND DEVELOPED FROM SOLID GREASE BASE AND THE RELEVANT PREPARATION PROCEDURE

[75] Inventors: Milka Šateva, Zagreb; Marija Koren-Marković, Posavski bregi; Ljerka Kondres, Ivaničko Graberje; Sajma Zajčić, Ivanić Grad; Nikola Janušić, Zagreb, all of Croatia

[73] Assignee: "IVASIM" d.d. Za proizvodnju kemijskih proizvoda, Ivanic Grad, Croatia

[21] Appl. No.: 964,235

[22] Filed: Nov. 4, 1997

[30] Foreign Application Priority Data

Nov. 7, 1996 [HR] Croatia ..... P960524A

[51] Int. Cl.[6] ..... C10M 111/02

[52] U.S. Cl. ..... 508/121; 508/122; 508/123

[58] Field of Search ..... 508/121, 123, 508/122

[56] References Cited

U.S. PATENT DOCUMENTS

| | | | |
|---|---|---|---|
| 4,525,287 | 6/1985 | Carstensen | 508/120 |
| 5,049,289 | 9/1991 | Jacobs | 508/115 |
| 5,085,700 | 2/1992 | Howard | 508/113 |
| 5,180,509 | 1/1993 | Jacobs | 508/126 |
| 5,431,831 | 7/1995 | Vincent | 508/116 |
| 5,498,351 | 3/1996 | Hefling | 508/123 |
| 5,536,422 | 7/1996 | Olcliges et al. | 508/121 |

OTHER PUBLICATIONS

Prengaman, R.D., "Thread Compounds—How do they Work?", *Petroleum Engineer International,* Oct. 1981, pp. 93–106.

Portwood, R.B., "Lubrication Requirements of Rotary Shouldered Tool Joint Connections", *NLGI Spokesman,* Nov. 1981, pp. 270–276.

Dresel, Von W.H., "Grundlegende Aspekte zukunftsorientierter Schmierfette", *Tribologie+Schmierungstechnik,* 40, Jahrgang, Mar. 1993, pp. 176–182.

Jacobs, N.L. et al, "New Standards Required for Environmental Thread Compounds", *NLGI Spokesman,* vol. 56, No. 4, Jul. 1992, pp. 13–137 through 17–141.

*Primary Examiner*—Jacqueline V. Howard

*Attorney, Agent, or Firm*—Pollock, Vande Sande & Amernick

[57] ABSTRACT

A new thread compound for tubing, casing and sucker rods which is composed of: mineral oil (freezing point in the range from −10° to −14° C.), polyisobutene solution (Staudinger index J.46 to 52) in mineral oil, anticorrosive additive based on organic compounds, which do not contain heavy metals and chlorinated hydrocarbons, and which is dissolved in mineral oil, modified alumino-silicate as trialkylaryl ammonium smectite, propylene carbonate density/20° C. 1.189, aluminium stearate (ash from 9.5 to 11.5 wgt. parts), graphite (quality as required in API 5A3), copper flake (quality as required in API 5A3), lead powder (quality as required in API 5A3) and zinc dust (quality as required in API 5A3), and a process for its manufacture are provided.

The thread compound is characterized by high resistance to temperature, pressure, extreme friction and wear.

18 Claims, No Drawings

THREAD COMPOUND DEVELOPED FROM SOLID GREASE BASE AND THE RELEVANT PREPARATION PROCEDURE

DESCRIPTION

Technical Field

The invention deals with new thread compounds developed from solid grease base, with high resistance to temperature, pressure, extreme friction and wear, as well as the relevant preparation practices.

Background of Invention

The increasing tribologic requirements respecting the resistance to temperature, pressure, high friction and wear cannot be satisfied with standard lubricants. For this reason, the manufacturers of lubricants have been invited to combine their efforts in close cooperation with the users in research of different practices for production of compounds for application in specific service conditions. For this reason, for specific applications are used for example thread compounds based on solid lubricants. Solid lubricants are solid substances, which owing to their structure have the ability to separate two contact surfaces, and thereby reduce friction and prevent sticking of the material 1.) F.Wunsch, Ingenieur Digest: 13 (1974) no.12, 14 (1975) no.1, 14 (1975) no.2, 14 (1975) no.3.

It has become evident that a new technologically advanced and economically justified practices should be found for production of thread compounds developed from solid lubricant base. This compound shall be applicable over a wide temperature range from −20° C. to +240° C. (according to the API 5A3 bulletin the application temperature is up to 150° C.).

Thread compounds developed from solid lubricant base should be applied in operating processes in petroleum industry, in direct service conditions in wells, and in geological and geophysical exploration, ensuring quality lubrication of threaded connections on drill pipes and tubing for oil and gas production. A drill pipe string or a tubing, run in the well down to as much as 7000 m in depth, are exposed to severe tensile, torque and combined stresses. Strength and life of the overall string will depend on the tightness of one threaded connection.

Considering that corrosive gases ($H_2S$, $CO_2$) occur in the course of drilling, testing and production operations, it is imperative that the threaded connections are executed with strictly defined torque in order to control the strain of the material directly affecting corrosion.

Thread compounds have an important role in the preservation of threaded connections (tightness, life) from which it is required to meet the following performance objectives:

1. to protect from wearing and sticking and/or jamming all components of threaded connection,
2. to prevent exceeding the torque during make-up and in operation,
3. to prevent deposition of residue on contact surfaces,
4. to enable break out of threaded connection with the same or lower torque,
5. not to act aggressively on the threaded connection material,
6. not to react with fluids in the well,
7. to adhere well to the thread,
8. not to disintegrate into corrosion products at elevated temperatures,
9. that solid particles do not set down during storage, and do not alter their properties, 10. to provide hermetic sealing of the threaded connection sealing surface,
11. to render impossible uncontrolled break out of threaded connection.

Thread compounds prepared from mineral oil base and soap densifiers contain crude lubricants. As presented in the paper published by R. David Prengman in the Petroleum Engineer International, 1981 (R. D. Prengman, Petroleum Engineer International, October 1981, p.93), solid components are usually added to thread compounds: copper flake, graphite, zinc dust and lead powder as well as teflon, whereas lead and zinc oxides, talk, silicium dioxide, clay and silicates are added as metal particle dispersants.

During threaded connection make up, there comes to pressure build-up affecting metal particles and to their consequent plastic and elastic deformation, in the course of which a great amount of energy is absorbed. Simultaneously, a thin film created by the mixture of soft metal particles will prevent contact between threaded connection surfaces, hence the consequent jamming and wear. Deformation of solids is the result of shearing, with consequent occurrence of the frictional strain during the make up process, which is directly dependent on:

a) threaded connection design and manufacturer's tolerances,
b) type of material,
c) quality and technology of the surface treatment,
d) composition of solids in the mixture.

If we observe the effect which solids in a lubricant produce upon a specific thread connection on which we wish to test frictional properties for different compositions of solids in the lubricant, then a), b) and c) are the constants from which may be inferred that friction is directly dependent on the composition of the lubricant.

During make up of a threaded connection it is of maximum importance that strains of the material amount to 50% of the elasticity limit as well as that these be strictly observed in a threaded connection. Final strains of the material depend on the amount of friction occurring within the thread during make up. Considering the importance of a lubricant in respect of the strains in the threaded connection, the French company "VALLOUREC" developed a practice for recording the coefficient of correction of a lubricant. This coefficient may be less and/or greater than 1. The correction coefficient obtained in measurement is used as multiplicator by which is multiplied the torque which has been determined for each threaded connection. An important role in this friction coefficient of correction have the solid components i.e. their proportions as well as the size and form of particles.

Fluid sealing is a primary purpose of thread compound, and it is accomplished with metal particles which agglomerate and deform in the process to plug all scratches, tiny recesses and roughness creating a solid, impermeable film on sealing surfaces, resisting displacement even at extreme differential pressures.

It would be impossible to achieve impermeability of such threaded connection without metal particles in thread compound, since lubricants without solid components would be displaced from the capillary fissure and the connection would not seal. This is even more important if gas-tightness is to be accomplished in a threaded connection, since gas, due to its considerably less viscous properties, penetrates through a capillary fissure far more easily than water.

Soft metal particles deform as a result of shearing strain during make up creating a thin film on metal surfaces, thereby preventing direct contact between metal surfaces and wearing and jamming that may result therefrom. This is important, in particular, in case of chrome alloy steel, which is impossible to protect from jamming with a lubricant not containing metal particles.

Due to the film created by metal particles which have been affected by plastic and elastic deformation, a threaded connection can take up a considerably higher impact load, since the film acts as a medium receiving the impact load energy and protecting the threaded connection from damage. Another property of metal particles is that they increase the contact surface of a thread between metal surfaces, reducing thereby the specific pressure at thread, which means that threaded connection can take up major load than it would have if a lubricant without metal particles were used. As a result of friction between particles themselves and the thread material the threaded connection behaves in a very stable manner because no extra tightening or break out is experienced in operation.

Uncontrolled tightening is one of the major problems since it can produce extreme strain in the threaded connection material, hence the damage or breakage. If uncontrolled tightening occurs in operation of a drill pipe string as a result of transmission of rotation, then such connections are also difficult to break up, which creates a great problem in practice, since mediums used in make up of threaded connections in most cases are not designed for major torques, such as may occur during break up. The important role which thread compounds have in prevention of uncontrolled tightening is taken up by metal particles due to the fact that much more energy is needed for additional deformation of particles which have been deformed once before. By correct selection of types and forms of metal particles, it is possible to achieve considerable resistance to uncontrolled tightening, without compromising other properties.

Thread compounds with only one type of metal particles present an inferior property which is manifested in settling of metal film on the sealing and threaded surfaces, which is increasing with each repeated application and make up. Thick stratification of film within the thread makes the connection too elastic and unstable. The author R. B. Portwood of the "JET LUBE" company describes in his paper published in the NLGI Spokesman from 1981 (R. B. Portwood, Lubrication Requirements of Rotary Shouldered Tool Joint, NLGI Spokesman 8, 65, November 1981) how the lubricating greases with multicomponent solids act on threads. The so called "SANDWICH" structure is formed within a lubricant, i.e. lead and zinc particles with low melting point are surrounded by graphite, copper and silicate particles preventing metal particles, which in this case are that of lead and zinc, from sticking or respectively glueing together. After break out of threaded connection this "SANDWICH" is broken up and removed from thread surface without subsequent brushing.

Thread compound should conform to the requirement that torque required for thread connection break up is equal or somewhat less than torque required for make up. This property is accomplished with selection of type and interrelationship of metal particles within the lubricating grease, and by action of other additives.

The quality of solid lubricating greases is a very important factor in the mentioned thread compounds for threaded connections. It has been defined with API /American Petroleum Institute/ bulletin 5A3 as shown in Table 1. The control and performance test requirements of thread compounds have been also defined with API 5A3 bulletin and shown in Table 2.

TABLE 1

SPECIFICATION OF SOLID LUBRICANTS AS PER API 5A3 BULLETIN

| | |
|---|---|
| **GRAPHITE:** | |
| Ash, wgt. % | 28 min., 27 max. |
| Particle size: | |
| Pass No. 50 sieve, wgt. % | min. 100 |
| On No. 100 sieve, wgt. % | max. 1.0 |
| On No. 200 sieve, wgt. % | min. 10 |
| Pass No. 325 sieve, wgt. % | 30 min., 80 max. |
| **ZINC DUST:** | |
| Metallic Zinc and Zinc contained in Zinc oxide, % | 98.0 |
| Metallic Zinc, wgt. % min. | 95.0 |
| Copper, iron, lead and cadmium, wgt. % max. | 1,0 |
| Calcium, calculated as CaO, wgt. % max. | 0.5 |
| Moisture and other volatiles, wgt. % max. | 0.1 |
| Zinc oxide/ZnO/ | Remainder |
| Particle size: | |
| Pass No. 100 sieve, wgt. % min. | 100.0 |
| Pass No. 325 sieve, wgt. % min. | 90.0 |
| **LEAD POWDER:** | |
| Free metal content, wgt. % min. | 95.0 |
| Lead oxide content, wgt. % max. | 5.0 |
| Particle size: | |
| On No. 100 sieve, wgt. % max. | 2.0 |
| Pass No. 325 sieve, wgt. %, max. | 30 min., 92 max. |
| **COPPER FLAKE** | |
| Copper, wgt. % min. | 97.0 |
| Grinding and polishing compound, wgt. % max. | 0.25 |
| Particle size: | |
| Pass No. 200 sieve, wgt. % min. | 100.0 |
| Pass No. 325 sieve, wgt. % min. | 99.0 |
| Particles whose thickness exceeds 5$\mu$ wgt. % max. | 5.0 |

TABLE 2

PHYSICO-CHEMICAL PROPERTIES OF THREAD COMPOUND AS PER API 5A3

| Test | Unit | Requirement | Method |
|---|---|---|---|
| Specific weight, 15° C. | g/ml | 1.97 | ISO 758<br>ISO 1183 |
| Dropping temperature | °C. | min. 138 | ASTM D 566<br>ASTM D 2265 |
| Worked penetration | mm/10 | 310–340 | ASTM D 1403 |

TABLE 2-continued

PHYSICO-CHEMICAL PROPERTIES OF THREAD COMPOUND AS PER API 5A3

| Test | Unit | Requirement | Method |
|---|---|---|---|
| Penetration after cooling (−17.8° C./3 h) | mm/10 | min. 200 | API 5A3 |
| Hardness according to NLGI | — | 1 | ASTM D 217 FTMS 791 B, number 321.2 |
| Oil separation, 100° C./24 h | vol. % | max. 10 | API 5A3 |
| Evaporation 100° C./24 h | vol. % | max. 3.75 | API 5A3 FTMS 791 B, number 321.2 |
| Leaching by water 66° C./2 h | wgt. % | max. 5 | API 5A3 |
| Gas evolution from compound 66° C./120 h | ml | max. 20 | API 5A3 |
| Brushing Ability | | | |
| −6.9° C. | wgt. % | min. 75% should remain on thread surface | API 5A3 |
| +66° C. | | min. 75% should remain on thread surface | |
| Salt chamber, 38° C./500 h | h | 500 | ASTM B 117/90 |
| Copper Corrosion inhibition properties 100° C./24 h | — | 1 b | ASTM D 4048 |
| Thread compound stability 138° C./24 h | vol. % | max. 25 | API 5A3 |

The authors N. L. Jacobs and W. D. Stringfellow of the company "BOMAC", in the paper published in NLGI Spokesman, 1992 (N. L. Jacobs,. W. D. Stringfellow, New Standards Required For Environmental Thread Compounds, NLGI Spokesman 56, 4, July 1992), give detailed hints and comments on each separate control test of thread compounds from the bulletin API 5A3 (dropping point, evaporation, oil separation, gas evolution, leaching by water and brushing ability) in respect of their functional action and in relation to the environmental impact of some of these components. Considering new knowledge of hazards and dentrimental effects to human environment of some constituents of thread compounds involved, they give suggestions as to the alterations of limitations for some of the tests (for ex. oil separation), or on introduction of standard practices for other tests (for inst. leaching by water—DIN 51807, IP 215/85). This is for the purpose of meeting functional requirements on one side, or accomplishment of minimum risk and hazard to the environment.

Application temperature for each lubricant is in a considerable measure dependent on dropping point of the relevant compound. The author A. T. Polishiik (from Sun Oil Co.) has already given as early as 1970 in the German patent number 1, 927, 373 27th Aug. 1970, the description of the preparation procedure for two lubricants:

The first—thickened with a complex soap and the second with modified aluminosilicate Baragel 24. By blending these two lubricants in specific proportions a compound has been obtained which has a considerably higher dropping point than the lubricants thickened only with soaps. The future development aspects anticipate also the use of a compound thickener with the objective to achieve improved compound properties as according to the author W. H. Dresel, Grundlegende Aspekte zukunftsorientierter Schmierfette, Trobologie+Schmierungstechnik, 40, 3/1993, 176–182.

SUMMARY OF INVENTION

It has been found, that all technical problems mentioned earlier in the text can be resolved as according to the invention with a new thread compound based on solid lubricating greases and with the possibility of application at temperatures ranging between −20° C. and +240° C., which is composed of the following:

from 25,36 to 1.73 wgt. parts of mineral oil with freezing point from −10° to −14° C.;

from 3.55 to 19.95 wgt. parts of polyisobutene solution (Staudinger index J◦46 to 52) in mineral oil in concentration from 30 to 4 wgt. parts)

from 6.69 to 4.72 wgt. parts of anticorrosive additive based on organic compounds, which do not contain heavy metals and chlorinated hydrocarbons, dissolved in mineral oil, from 3.6 to 2.1 wgt. parts of modified aluminosilicate as trialkyl aryl ammonium smectite, from 0.8 to 1.5 wgt. parts of propylene carbonate density/20° C.=1.189, from 1.5 to 3.5 wgt. parts of aluminium stearate (ash from 9.5 to 11.5 wgt. parts), from 17.5 to 19 wgt. parts of graphite (quality as defined by API 5A3), from 3 to 4 wgt. parts copper flake (quality as defined by API 5A3), from 29 to 31 wgt. parts of lead powder (quality as defined by API 5A3) and from 9 to 12.5 wgt. zinc dust (quality as defined by API 5A3)

The next subject of this invention is the procedure for preparation of the new thread compound developed from solid grease base and with the possibility of application over the range of temperatures from −20° C. and +240° C., which is done in the following manner:

into 5 to 65 wgt. parts of mineral oil, freezing point from −10° to −14° C. is added 66 to 8 wgt. parts of polyisobutene solution ((Staudinger index J◦46 to 52) in mineral oil solution in concentration from 4 to 35 wgt. parts and it is mixed at temperature ranging from 15° to 30° C. over the period of 15 to 30 min. at a rate of 600 to 2.000 r/min., then 5 to 30 wgt. parts of anticorrosive additive, based on organic compounds which do not contain heavy metals and chlorinated hydrocarbons, solved in mineral oil, is added and mixed at temperature ranging from 15° to 30° C. over the period of 15 to 30 min. at a rate of 600 to 2.000 r/min., then 2 to 15 wgt. parts of modified aluminosilicate as trialkylaryl ammonium smectite is gradually added and mixed at temperature ranging from 15° to 30° C. over the period of 15 to 30 min. at a rate of 300 to 600 r/min., and then again at temperature ranging from 15° to 30° C. over the period of 15 to 30 min. at a rate of 600 to 2.000 r/min., then the reaction mass is thickened in part, by passing it for ex. through a colloidal mill at minimum clearance of 0.0254 cm between a rotor and a stator, and after adding 0.5 to 10 wgt. parts of propylene carbonate density/20° C. 1.189, it is mixed at temperature ranging from 15° to 30° C. over the period of 30 to 60 min. at a rate of 600 to 2.000 r/min., then the mass reaches its maximum thickness and homogeneity, for inst. by passing it through a three-roll mill at a roll pressure from 10 to 30 bar, or by passing it through a colloidal mill at a minimum clearance of 0.0254 cm between a rotor and a stator, then into 20 to 40 wgt. parts of the maximally thickened and homogeneized reaction mass is added 1 to 10 wgt. parts of aluminium stearate (ash from 9.5 to 11.5 wgt. parts) and mixed at temperature ranging from 15° to 30° C. over the period of 30 to 60 min. at a rate of 300 to 600 r/min., and then again at temperature ranging from 15° to 30° C. over the period of 15 to 60 min. at a rate of 600 to 2.000 r/min., then the reaction mass is well homogeneized, for inst. by passing it through a three-roll mill at a roll pressure from 10 to 30 bar, and 10 to 25 wgt. parts of graphite (quality as defined with API 5A3) are gradually added into it and the mass is mixed at temperature ranging from 15° to 30° C. over the period of 15 to 30 min. at a rate of 300 to 600 r/min., and then again at temperature ranging from 15° to 30° C. over the period of 15 to 30 min. at a rate of 600 to 2.000 r/min., then 2 to 10 wgt. parts of copper flakes (quality as defined with API 5A3) are gradually added into it and the mass is mixed at temperature ranging from 15° to 30° C. over the period of 15 to 30 min. at a rate of 300 to 600 r/min., and then again at temperature from 15° to 30° C. over the period of 15 to 30 min. at a rate of 600 to 2.000 r/min., then 15 to 40 wgt.parts of lead powder (quality as defined with API 5A3) are gradually added into it and the mass is mixed at temperature ranging from 15° to 30° C. over the period of 15 to 30 mn at a rate of 300 to 600 r/min., and then again at a temperature ranging from 15° to 30° C. over the period of 15 to 30 min. at a rate of 600 to 2.000 r/min., the 5 to 20 wgt. parts of zinc dust (quality as defined with API 5A3) are gradually added into and the mass is mixed at a temperature ranging from 15° to 30° C. over the period of 15 to 30 min. at a rate of 300 to 600 r/min., and then again at temperature ranging from 15° to 30° C. over the period of 15 to 30 min. at a rate of 600 to 2.000 r/min., and thus prepares product is homogeneized, for inst. by passing it through a single-roll whereupon it should be left to repose for at least 24 hours at room temperature.

DESCRIPTION OF BEST AND VARIOUS MODES FOR CARRYING OUT INVENTION

As it has been previously said, thread compounds of the classic type are prepared from mineral oil base and soap thickeners, whereas according to this invention thread compounds are prepared from mineral oil base and non soap thickeners for ex. aluminosilicates. Thread compounds are colloidal dispersant systems obtained by thickener disperion in a liquid stage. Applied as thickeners are metal soaps, complex soaps and non soap thickeners i.e. various types of clay, silicium compounds as well as various organic thickeners—polymers, polyurea and others. The common property of metal soaps is that, dependent on the temperatere they pass through different rheologic stages. At higher temperatures the soaps dissolve and become liquid. Such alterations of soaps are reflected also in changes of lubricant structure, so that at higher temperatures they become liquid, hence they cannot be used at higher temperatures. Non soap thickeners, such as various types of clay behave in a completely different manner. They do not pass through all these stages, so they do not dissolve at higher temperatures. Thread compounds prepared with non soap thickeners, have a very high dropping point and present irrelevant or little change of consistency at higher temperatures.

The papers of the authors McAtee, Fariss et al. Journal of colloid science, 18 409 to 420 (1963), NLGI Spokesman 23 432 to 437 (1960) have attesed to explain the changes happening within thickener systems—a liquid phase, as well as the interconnecting mechanism between them in the following manner:

Organic molecules of organophilic bentotite are tied onto the surface of a clay mineral particle with ammonium cation which is bearing a long hydrocarbon chain. Covering ca.80% of the clay surface, they change its structure, form chain products and thus a strong organiophilic thickener is created, consisting of parallely oriented surfaces. Thickener gives consistency and acts as a bearer of the liquid stage. However, a very important role has a dispersant additive, which is a polar component and renders possible formation of a stable colloidal dispersant system. Formation of the stable colloidal dispersant hydrocarbon systems by means of organophilic clays is based on the theory of double layer, while an electrostatic link ties up the liquid phase with organophilic clay. Dispersant additive as a polar component is indispensable in preparation of a thread compound, since its addition affects the separation of organophilic clay flakes. Adsorption of dispersant at organophilic clay surface increases the dielectric constant of the organophilic clay affecting separation of organic cation from clay flakes which is reflected on the clay flake separation and at optimal concentration it ties up with hydrocarbon component from the liquid stage, which is very important in preparation of lubricants based on organophilic clay, since the liquid phase "film" around particles (flakes) is so strong, that the liquid phase separation is very unlikely to occur. Application of dispersant improves solvatation of the liquid phase, which is thickened with organophilic clay. The more polar the liquid phase is, the more liophilic is the organophilic clay—liquid phase system which means in practice that a stable colloid dispersant is created. Thus thread compounds with improved properties are accomplished, for inst. lubricating properties of prepared samples are better, records of specific properties are better. Higher dropping point, for example, makes also possible higher application temperature of up to 240° C., lower evaporation values, lower oil separation values, lower values of leaching by water etc.

Physical/chemical properties of thread compounds under A and B are shown in table 3. Penetration of A and B thread compounds according to API 5A3 bulletin is set by standard at 25° C., and parallel with this standard, the penetration of sample after cooling is also determined at −17.8° C. Dropping point is determined in conformity with methods ASTM D 566 and ASTM D 2265, and the permitted value as per bulletin API 5A3 is min. 138° C., whereas the sample A has a dropping point of min. 200° C., a sample B min. 170° C. The results of measurements of dropping point for A and B samples are within permitted values of min. 138° C. required in API 5A3 bulletin.

However, the saimnple A which has a dropping point at min. 200° C. can be used at temperatures above 150° C. i.e. tip to 240° C. (according to API 5A3 bulletin the application temperature is up to 150° C.). The results of evaporation measurements over 24 hours at 100° C. for A and B samples are also within allowed tolerances of max. 3.75 vol. parts, while evaporation tolerances for A and B samples are max. 2.2. The measurement results for oil separation for A and B samples are also within tolerance values of max. 10 vol. parts, whereas oil separation values for A and B samples are max. 7.5 vol. parts. The recorded values for leaching by water are also within established tolerances max. 5 wgt. parts. Brushing ability at −6.90° C. and at +66° C. is also satisfactory. Corrosion inhibition properties according to the ASTM B-1 17/90 method are 500 hr at 38° C., and the test results for A and B thread compound samples have demonstrated that A and B thread compound samples can stand a salt chamber over more than 500 hours. The test results for penetration as well as all quoted physical/chemical properties of A and B thread compounds lie within allowed tolerance values prescribed by API 5A3 bulletin.

The invention has been illustrated with the following examples, which do not limit it to any extent.

Compound A consists of:

25.36 wgt. parts of mineral oil, freezing point in the range from −10° to −14° C., 3.55 wgt. parts of polyisobutenie solution (Staudinger index $J_{\circ}$46 to 52) in mineral oil in concentration of 30 wgt. parts, 6.69 wgt. parts of anticorrosive additive based on organic compounds, which do not contain heavy metals and chlorinated hydrocarbons, and which is dissolved in mineral oil, 3.6 wgt. parts of modified aluminosilicate as trialkylaryl ammonium smectite, 0.8 wgt. parts of propylene carbonate density/20° C. 1.189, 1.5 wgt. parts of aluminium stearate (ash from 9.5 to 11.5 wgt. parts), 17.5 wgt. parts of graphite (quality as required in API 5A3), 3 wgt. parts of copper flakes (quality as required in API 5A3), 29 wgt. parts of lead powder (quality as required in API 5A3) and 9 wgt. parts of zinc dust (quality as required in API 5A3).

Compound B consists of:

1.73 wgt. parts of mineral oil, freezing point in the range from −10° to −14° C., 19.95 wgt. parts of polyisobutene solution (Staudinger index $J_{\circ}$46 to 52) in mineral oil in concentration of 4 wgt. parts, 4.72 wgt. parts of anticorrosive additive based on organic compounds, which do not contain heavy metals and chlorinated hydrocarbons, and which is dissolved in mineral oil, 2.1 wgt. parts of modified aluminiosilicate as trialkylaryl ammonium smectite, 1.5 wgt. parts of acetone, 3.5 wgt. parts of aluminium stearate (ash from 9.5 to 11.5 wgt. parts, 19 wgt. parts of graphite (quality as required in API 5A3), 4 wgt. parts of copper flakes (quality as required in API 5A3), 31 wgt. parts of lead powder (quality as required in API 5A3) and 12,5 wgt. parts of zinc dust (quality as required in API 5A3).

What we claim is:

1. Thread compound based on solid lubricating greases with possibility of application over the range of temperatures from −20° C. to +240° C., comprising 25.36 to 1.73 wgt. parts of mineral oil with freezing point from −10° to −14° C.,

TABLE 3

PHYSICAL/CHEMICAL PROPERTIES OF A AND B THREAD COMPOUNDS AS PER API 5A3 BULLETIN

| | | | Results of Thread Compounds Tests | | |
|---|---|---|---|---|---|
| Test | Unit | Requirement | A | B | Method |
| Specific weight, 15° C. | g/ml | 1.97 | 1.9645 | 1.9652 | ISO 758<br>ISO 1183 |
| Dropping temperature | °C. | min. 138 | min. 200 | min. 170 | ASTM D 566<br>ASTM D 2265 |
| Worked penetration | mm/10 | 310–340 | 310–340 | 310–340 | ASTM D 1403 |
| Penetration after cooling (−17.8° C./3 h) | mm/10 | min. 200 | 220–250 (NLGI = 3) | 220–250 (NLGI = 3) | API 5A3 |
| Hardness as per NLGI | — | 1 | 1 | 1 | ASTM D 217 |
| Oil separation, 100° C./24 h | vol. % | max. 10 | 7.5 | 7.0 | FTMS 791 B, number 321.2<br>API 5A3 |
| Evaporation, 100° C./24 h | vol. % | max. 3.75 | 2.2 | 2.0 | API 5A3 |
| Leaching by water 66° C./2 h | wgt. % | max. 5 | max. 5 | max. 5 | FTMS 791 B, number 321.2<br>API 5A3 |
| Gas evolution from the compound 66° C./120 h | ml | max. 20 | 0–5 | 0–5 | API 5A3 |
| Brushing ability | | | | | |
| −6.9° C. | wgt. % | min. 75% should remain on thread surface | satisfactory | satisfactory | API 5A3 |
| +66° C. | | min. 75% should remain on thread surface | | | |
| Salt Chamber, 38° C./500 h | h | 500 | more than 500 | more than 500 | ASTM B 117/90 |
| Copper Corrosion Inhibition properties 100° C./24 h | — | 1b | 1a | 1a | ASTM D 4048 |
| Compound stability 138° C./24 h | vol. % | max. 25 | 2.8 | 2.6 | API 5A3 |

3.55 to 19.95 wgt. parts of polyisobutene solution in mineral oil in concentration from 4 to 35 wgt. parts, 6.69 to 4.72 wgt. parts of anticorrosive additive based on organic compounds, which do not contain heavy metals and chlorinated hydrocarbons, and which is dissolved in mineral oil, 3.6 to 2.1 wgt. parts of modified aluminosilicate as trialkylaryl ammonium smectite, 0.8 to 1.5 wgt. parts of propylene carbonate density/20° C.=1.189, 1.5 to 3.5 wgt. parts of aluminum stearate, 17.5 to 19 wgt parts of graphite, 3 to 4 wgt. parts copper flake, 29 to 31 wgt. parts of lead powder and 9 to 12.5 wgt. zinc dust.

2. Process for the preparation of thread compounds claimed in claim 1, which comprises adding into 5 to 65 wgt. parts of mineral oil, freezing point from −10° to −14° C. 66 to 8 wgt. parts of polyisobutene solution in mineral oil solution of concentration from 30 to 4 wgt. parts and mixing at temperature ranging from 15° to 30° C. over the period of 15 to 30 min. at a rate of 600 to 2.000 r/min., then adding 15 to 30 wgt. parts of anticorrosive additive, based on organic compounds which do not contain heavy metals and chlorinated hydrocarbons, dissolved in mineral oil, and mixing at temperature ranging from 15° to 30° C. over the period 15 to 30 min. at a rate of 600 to 2.000 r/min., then gradually adding 2 to 15 wgt. parts of modified aluminosilicate as trialkylaryl ammonium smectite and mixing at temperature ranging from 15° to 30° C. over the period of 15 to 30 min. at a rate of 300 to 600 r/min., and then again at temperature from 15° to 30° C. over the period of 15 to 30 min. at a rate of 600 to 2.000 r/min., then thickening the reaction mass in part and after adding 0.5 to 10 wgt. parts of propylene carbonate density/20° C. 1.189, mixing it at temperature ranging from 15° to 30° C. over the period of 30 to 60 min. at a rate of 600 to 2.000 r/min., then permitting the mass to reach its maximum thickness and homogeneity, then adding into 20 to 40 wgt. parts of the maximally thickened and homogenized reaction mass 1 to 10 wgt. parts of aluminum stearate and mixing at temperature ranging from 15° to 30° C. over the period of 30 to 60 min. at a rate of 300 to 600 r/min., and then again at temperature ranging from 15° to 30° C. over the period of 15 to 60 min. at a rate of 600 to 2.000 r/min., then well homogenizing the reaction mass and gradually adding 10 to 20 wgt. parts of graphite into it and mixing the mass at temperature ranging from 15° to 30° C. over the period of 15 to 30 min. at a rate of 300 to 600 r/min., and then again at temperature ranging from 15° to 30° C. over the period of 15 to 30 min. at a rate of 600 to 2.000 r/min., then gradually adding 2 to 10 wgt. parts of copper flakes into it and mixing the mass at temperature ranging from 15° to 30° C. over the period of 15 to 30 min. at a rate of 300 to 600 r/min., and then again at temperature ranging from 15° to 30° C. over the period of 15 to 30 min. at a rate of 600 to 2.000 r/min., then gradually adding 15 to 40 wgt. parts of lead powder into it and mixing the mass at temperature ranging from 15° to 30° C. over the period of 15 to 30 min. at a rate of 300 to 600 r/min., and then again at temperature ranging from 15° to 30° C. over the period of 15 to 30 min. at a rate of 600 to 2.000 r/min., then gradually adding 15 to 20 wgt. parts of zinc dust into it and mixing the mass at temperature ranging from 15° to 30° C. over the period of 15 to 30 min. at a rate of 300 to 600 r/min., and then again at temperature ranging from 15° to 30° C. over the period of 15 to 30 min. at a rate of 600 to 2.000 r/min., and homogenizing the thus prepared product and leaving it to repose for at least 24 hours at room temperature.

3. The thread compound of claim 1 wherein said polysobutene solution has a Staudinger index J.46 to 52.

4. The thread compound of claim 1 wherein said aluminum stearate has an ash content from 9.5 to 11.5 wgt. parts.

5. The thread compound of claim 1 wherein said graphite has the quality as required in API 5A3.

6. The thread compound of claim 1 wherein said copper flake has the quality as required in API 5A3.

7. The thread compound of claim 1 wherein said lead powder has the quality as required in API 5A3.

8. The thread compound of claim 1 wherein said zinc dust has the quality as required in API 5A3.

9. The process of claim 2 wherein said thickening the reaction mass in part comprises passing it through a colloidal mill at minimum clearance of 0.0254 cm between a rotor and a stator.

10. The process of claim 2 wherein said polysobutene solution has Staudinger index J.45 to 52.

11. The process of claim 2 wherein said well homogenizing said reaction mass comprise passing said reaction mass through a three-roll mill at a roll pressure from 10 to 30 bar.

12. The process of claim 2 wherein said graphite has quality as required i API 5A3.

13. The process of claim 2 wherein copper flakes have quality as required in API 5A3.

14. The process of claim 2 wherein said lead powder has quality as required in API 5A3.

15. The process of claim 2 wherein said zinc dust has quality as required in API 5A3.

16. The process of claim 2 wherein said permitting the mass to reach its maximum thickness and homogeneity comprising passing it through a three-roll mill at a roll pressure from 10 to 30 bar, or by passing it through a colloidal mill at minimum clearance of 0.0254 cm between a rotor and a stator.

17. The process of claim 16 wherein said thickening the reaction mass in part comprises passing it through a colloidal mill at minimum clearance of 0.0254 cm between a rotor and a stator, said well homogenizing the reaction mass comprises passing it through a three-roll mill at a roll pressure from 10 to 30 bar, and said homogenizing the thus prepared product comprises passing it through a single-roll.

18. The process of claim 2 wherein said homogenizing the thus prepared product comprises passing it through a single-roll.

* * * * *